US007063050B2

(12) United States Patent
Watanabe et al.

(10) Patent No.: US 7,063,050 B2
(45) Date of Patent: Jun. 20, 2006

(54) ENGINE-DRIVEN HANDHELD VACUUM/BLOWER

(75) Inventors: Mitsunori Watanabe, Shizuoka-ken (JP); Hiroshi Kubota, Shizuoka-ken (JP); Hiroyuki Noda, Shizuoka-ken (JP)

(73) Assignee: Fuji Robin Kabushiki Kaisha, Numazu (JP)

( * ) Notice: Subject to any disclaimer, the term of this patent is extended or adjusted under 35 U.S.C. 154(b) by 0 days.

(21) Appl. No.: 11/012,229

(22) Filed: Dec. 16, 2004

(65) Prior Publication Data

US 2005/0132983 A1 Jun. 23, 2005

(30) Foreign Application Priority Data

Dec. 19, 2003 (JP) ..... 2003-423186

(51) Int. Cl.
*F01P 1/02* (2006.01)

(52) U.S. Cl. ..... 123/41.7; 15/344; 123/198 E

(58) Field of Classification Search ..... 123/41.7, 123/198 E; 15/344
See application file for complete search history.

(56) References Cited

U.S. PATENT DOCUMENTS 5,542,380 A * 8/1996 Chatten ..... 123/41.7

FOREIGN PATENT DOCUMENTS

JP 10-205489 8/1998
JP 2001-003761 1/2001

* cited by examiner

*Primary Examiner*—Tony M. Argenbright
*Assistant Examiner*—Katrina Harris
(74) *Attorney, Agent, or Firm*—McGinn IP Law Group, PLLC

(57) ABSTRACT

In an engine-driven handheld vacuum/blower, a first grip is provided as one part of an outer shape of an engine casing in which an engine is mounted, and a second grip is formed on a fuel tank which forms another part of the outer shape of the engine casing. The first grip and the second grip are positioned on the opposite sides of the center axis of the engine. Therefore, since there is no unbalanced load applied on either of both the hands, an operator can easily maintain the posture during operation, and can work with the vacuum/blower under good efficiency.

19 Claims, 11 Drawing Sheets

ENGINE-DRIVEN HANDHELD VACUUM/BLOWER

BACKGROUND OF THE INVENTION

The present invention relates to an engine-driven handheld vacuum/blower apparatus, and more particularly to a handgrip mechanism thereof.

The present application claims priority from Japanese Patent Application No. 2003-423186, the disclosure of which is incorporated herein by reference.

An engine-driven handheld vacuum/blower apparatus (hereinafter referred to as "vacuum/blower") as shown, for example, in Japanese patent application laid-open No. Hei 10-205489 is known as one for collecting or gathering scattered lightweight rubbish such as fallen leaves on the ground through vacuuming or blowing with an engine-driven impeller.

The vacuum/blower of this type is usually held by operator's hands during the operation and thus required to include any configuration for grasping and holding it.

FIG. 11 shows one example of handgrips of a conventional engine-driven handheld vacuum/blower.

In FIG. 11, the vacuum/blower is oriented parallel to the ground. An impeller case 201 accommodating an impeller is coupled to an engine casing 200. A suction pipe 202 is connected to the impeller case 201 at a position corresponding to the rotation center of the impeller inside, and a blowpipe 203 is connected to the circumference of the impeller case 201 such as to extend in a tangential direction of the impeller.

On top of the engine casing 200 stands a first grip 200A, and a second grip 200B protrudes from near the center axis of the engine in a direction orthogonal to that of the first grip 200A.

The first grip 200A includes a throttle lever 200A1 and a stop switch 200A2. The operator grasps the first grip to hold the engine casing 200 in a suspended manner.

The second grip 200B is not held for supporting the engine casing 200 in a suspended manner but rather for supporting its weight while maintaining an inclined position of the engine casing 200 when, for example, the suction pipe 202 is oriented toward the ground.

In an operation where rubbish such as fallen leaves is collected using the suction pipe 202, when the engine casing 200 is inclined to orient the suction pipe 202 to the ground, the entire weight of the engine casing including the engine is mostly carried on the side of the second grip 200B which is nearer to the center axis G of the engine. This causes more hand fatigue on one hand grasping the second grip 200B than the other on the first grip 200A. The operator may have to stop the rubbish collecting operation to relieve the fatigue of the hand on the second grip 200B, resulting in poor work efficiency. Furthermore, because of the position of the second grip 200B extending perpendicularly to the first grip 200A, it is hard to form the second grip 200B in one piece with the engine casing 200 as with the first-grip 200A. Thus, the second grip 200B is usually manufactured as a separate part and attached to the engine casing 200 afterwards.

The structure according to the conventional technique thus led to poor work efficiency and high component and production costs.

The above mentioned Japanese patent application laid-open No. Hei 10-205489 shows an alternative arrangement of the handgrips on the engine casing. While the first grip is the same as that shown in FIG. 11, the second grip is formed as part of a stand which extends from a side face of the engine casing.

Another conventional structure is one as shown in Japanese patent application laid-open No. 2001-3761, which has a separate grip member attached on a fuel tank which is mounted on the engine casing.

In the case where the grip is formed as part of the stand, because the stand is provided as a separate component, a size reduction of the engine casing is not achieved. Furthermore, as long as the grip is part of the stand, a cost reduction is hard to achieve because of strength requirements of the stand such as material and size.

In the structure shown in Japanese patent application laid-open No. 2001-3761, because the grip is attached to the fuel tank which is mounted on the engine casing as a separate component, the engine casing with the fuel tank mounted thereon is inevitably bulky. In addition, there is a danger that heat from the engine casing may be transmitted to the grip through the fuel tank and the operator may suffer a burn on the hand after working with the vacuum/blower for a long time, because of which good workability is not expected.

SUMMARY OF THE INVENTION

Based on the foregoing, it is an object of the invention to overcome the problems associated with the conventional technique and to provide an engine-driven handheld vacuum/blower having a compact and low-cost structure which can improve work efficiency.

According to a first aspect of the present invention, provided is an engine-driven handheld vacuum/blower in which a fist grip is provided as one part of an outer shape of an engine casing in which an engine used as a power source is mounted, and a second grip is formed on a fuel tank which makes up another part of the outer shape of the engine casing. The first grip and the second grip are positioned on opposite sides of a center axis of the engine.

In the engine-driven handheld vacuum/blower, according to a second aspect thereof, the second grip may be oriented such that its lengthwise direction is parallel to that of the first grip, and comprise a dented part formed on the surface of the fuel tank to receive operator's fingers. The dented part may have a recessed part for receiving an operator's thumb and a convexo-concave portion for receiving the fingers other than the thumb.

In the engine-driven handheld vacuum/blower, according to a third aspect thereof, the fuel tank may be made of a transparent or translucent molded plastic member and include a partition inside which divides an area consisting of the recessed portion and the convexo-concave portion formed as the second grip from the other part of the fuel tank. The part of the fuel tank other than the area consisting of the recessed portion and the convexo-concave portion may be filled with fuel.

In the engine-driven handheld vacuum/blower, according to a fourth aspect thereof, an insulating protective member may be provided between the engine mounted in the engine casing and the fuel tank, in which the insulating protective member is spaced from the second grip of the fuel tank at a distance which is set such that the fingers on the second grip do not touch the insulating protective member and not feel much heat from the engine.

In the engine-driven handheld vacuum/blower, according to a fifth aspect thereof, the insulating protective member may include an air passage for taking in outer air, in which the air passage is formed by slits of a size which does not allow passage of the fingers.

In the engine-driven handheld vacuum/blower, according to a sixth aspect thereof, the insulating protective member may be provided in one piece with an engine mounting part of the engine casing.

According to the first aspect of the present invention, the second grip is positioned opposite the first grip across the center axis of the engine and formed as a part of the fuel tank which makes up a part of the outer shape of the engine casing. Because the second grip is not a separate part, it can be provided without increasing the product size. In addition, since the fuel tank is formed as a part of the outer shape of the engine casing, the center of weight of the entire vacuum/blower including the first and second grips is not largely offset from the center of weight of the engine. That is, the entire weight of the engine and its casing is supported at the positions on opposite sides of the center of the engine. The grips thus ensure good workability because there is no unbalanced load on either of the operator's hands.

According to the second aspect, the second grip, which has a recessed part for receiving an operator's thumb and a convexo-concave portion for receiving the fingers other than the thumb, both formed on the fuel tank, allows the operator to maintain a secure grip on the surface of the fuel tank without slippage. The recessed part, in particular, which is for fitting in the thumb, allows easy grasp and assures a firm and stable grip.

According to the third aspect, the remaining amount of fuel can be checked visually from outside because the fuel tank is transparent or translucent. The partition which divides the area consisting of the second grip from the fuel-filled part of the tank protects the fingers from fuel in the event of the fuel running out of the tank.

According to the fourth aspect, the insulating protective member prevents the fingers on the second grip from directly touching the engine casing. Furthermore, since the insulating protective member is positioned with a predetermined distance from the engine casing so that the fingers can readily be inserted to grasp the second grip, the operator can safely keep holding the second grip.

According to the fifth aspect, the insulating protective member, which protects the fingers on the second grip from heat, further includes an air passage so as to secure supply of outer air for cooling the engine through the small gap between the operator's fingers and the engine case. Moreover, because the air passage is formed by slits of a size which does not allow passage of the fingers, the insulating protective member can simultaneously achieve the different objectives of preventing the fingers from touching the engine casing and of taking in outer air into the casing.

According to the sixth aspect, the insulating protective member can be formed in one piece with the engine mounting part of the engine casing, so that the manufacturing process is simplified and variations in positional accuracy of the parts are avoided to reduce costs while achieving heat insulating and engine cooling effects.

BRIEF DESCRIPTION OF THE DRAWINGS

These and other objects and advantages of the present invention will become understood from the following description with reference to the accompanying drawings, wherein.

DETAILED DESCRIPTION OF THE PREFERRED EMBODIMENTS

Preferred embodiments of the present invention will be hereinafter described with reference to the accompanying drawings.

Figure 1:
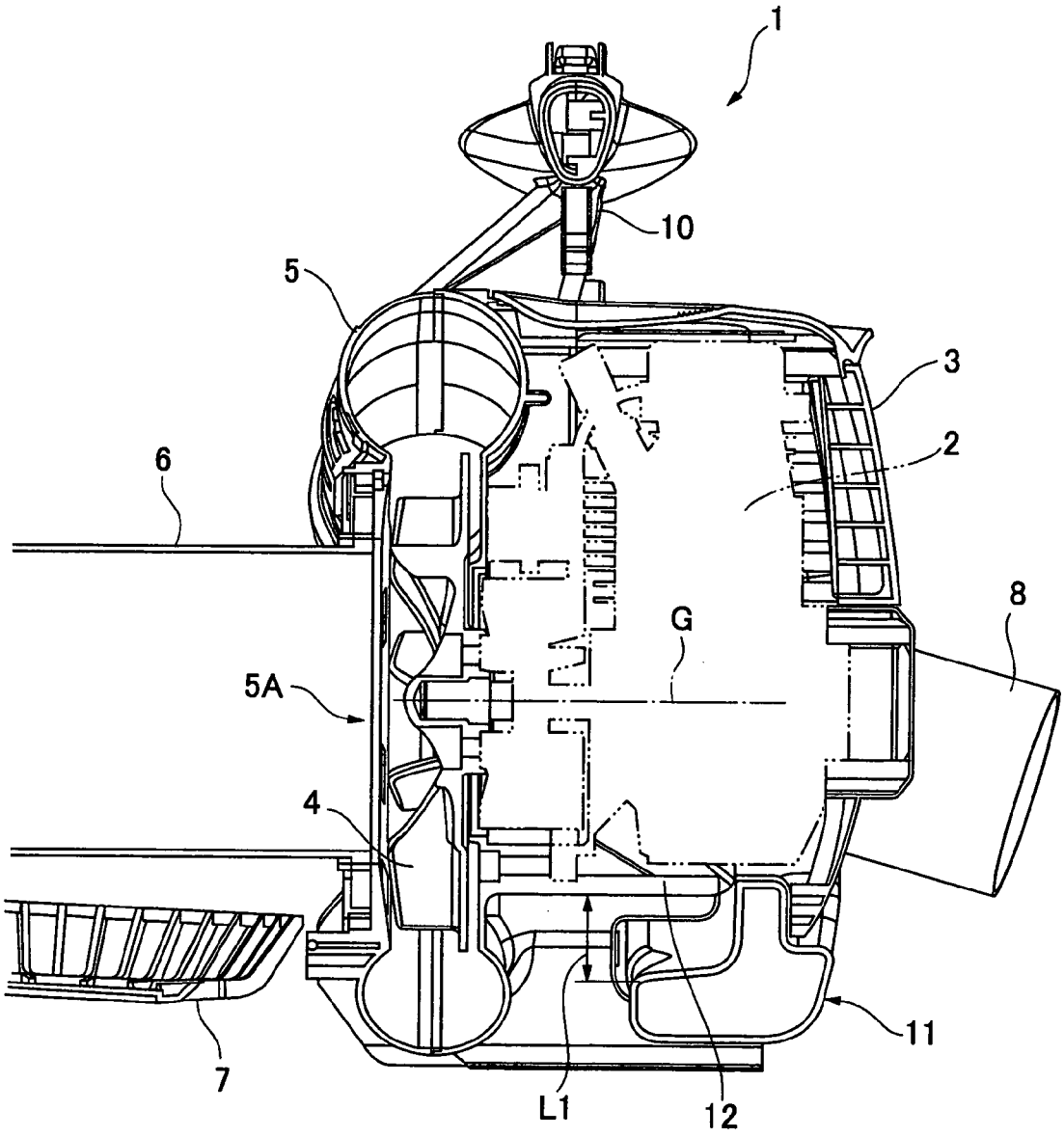
FIG. 1 is a view for explaining the structure of an engine-driven handheld vacuum/blower according to one embodiment of the invention.

FIG. 1 is a view for explaining the structure of one embodiment of the engine-driven handheld vacuum/blower 1 according to the invention. The vacuum/blower 1 includes an engine 2 and an engine casing 3 for supporting the engine 2 mounted therein.

The engine casing 3 includes a support part 3B in which the engine 2 (denoted by two dot-dash lines in FIG. 1) is mounted, and an impeller case 5 accommodating an impeller 4 inside and being coupled to the engine casing 3. The impeller case 5 has an opening 5A in the center for connecting a suction pipe 6. The opening 5A is closed with a cover 7 when vacuuming is not performed.

Figure 3:
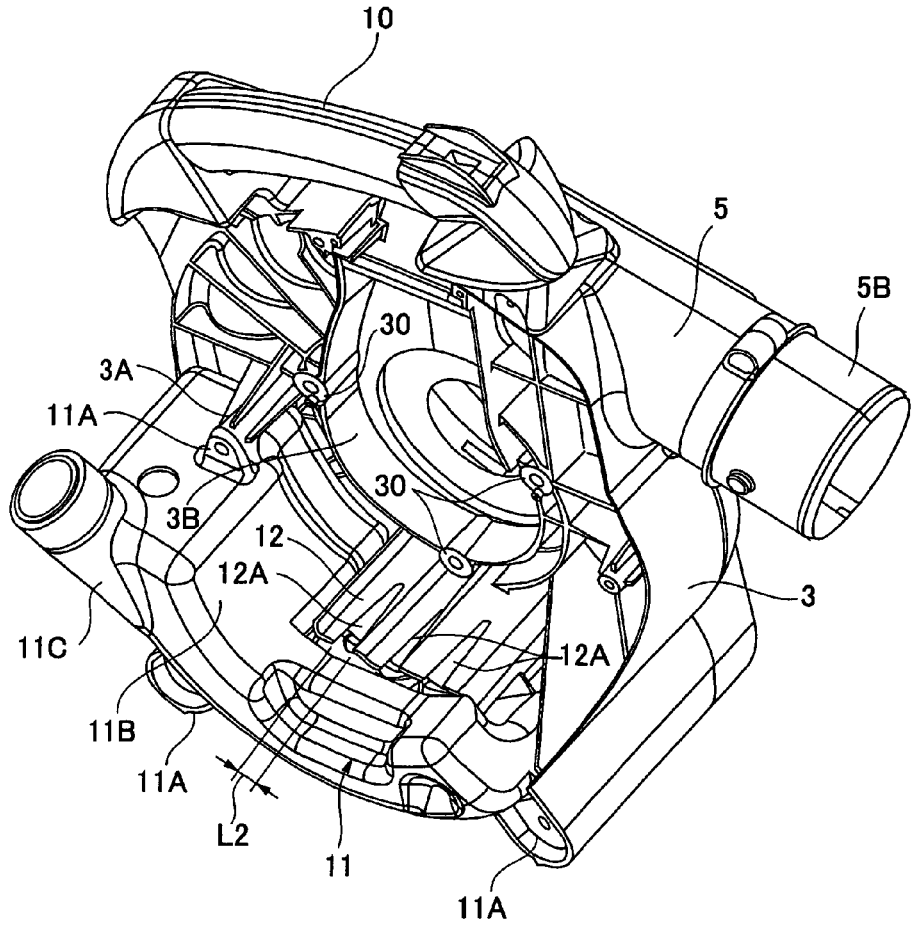
FIG. 3 shows the handheld vacuum/blower of FIG. 1 without the engine.

A connector 5B of a discharge pipe 8 extends in a tangential direction from part of the circumferential surface of the impeller case 5, as shown in FIG. 3 which illustrates the engine casing 3 without the engine. The discharge pipe 8 is connected to a dust bag 9 at the distal end as shown in FIGS. 9 and 10.

In the case where lightweight rubbish are sucked up from the ground, the suction pipe 6 is made to communicate with the opening 5A of the impeller case 5 as shown in FIG. 1.

Figure 9:
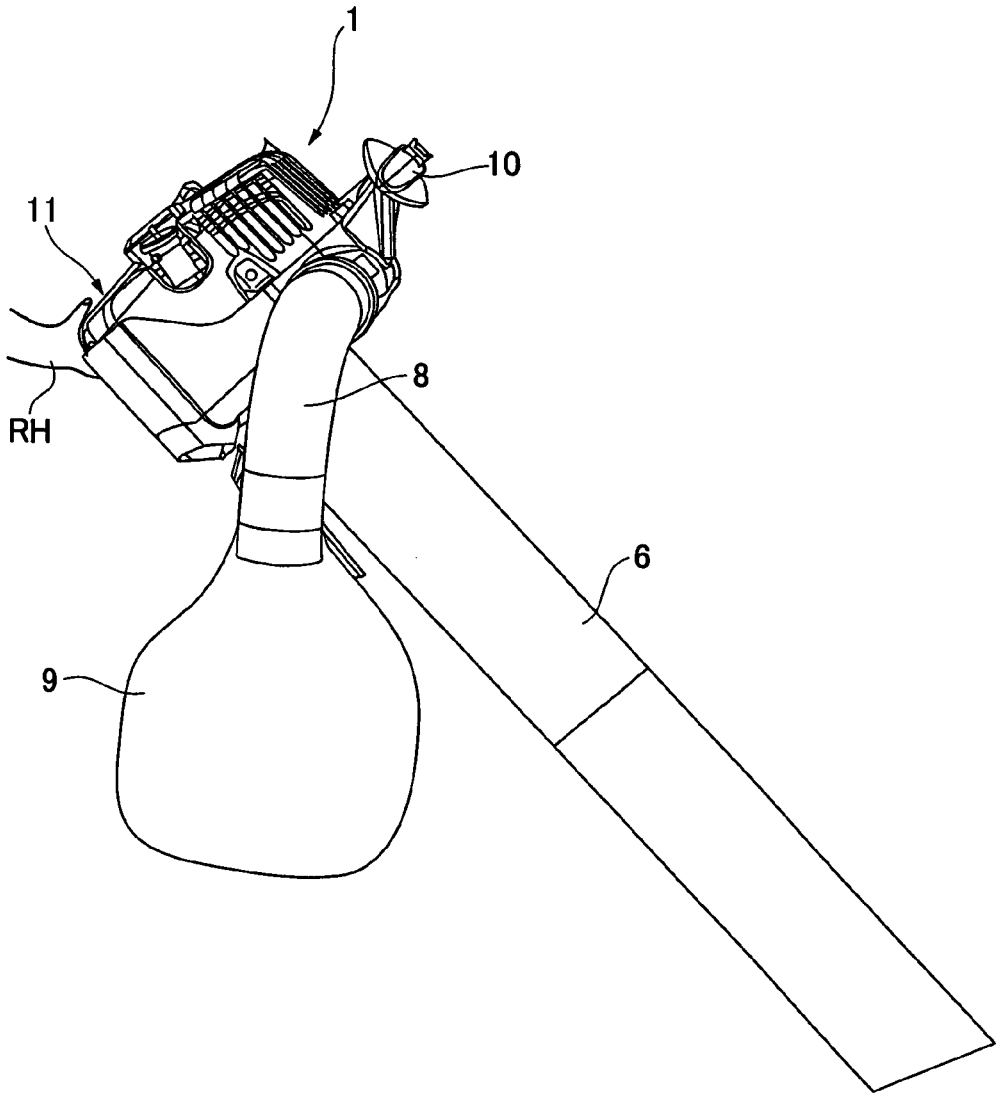
FIG. 9 shows the handheld vacuum/blower in one usage example according to the embodiment of the invention.
Figure 10:
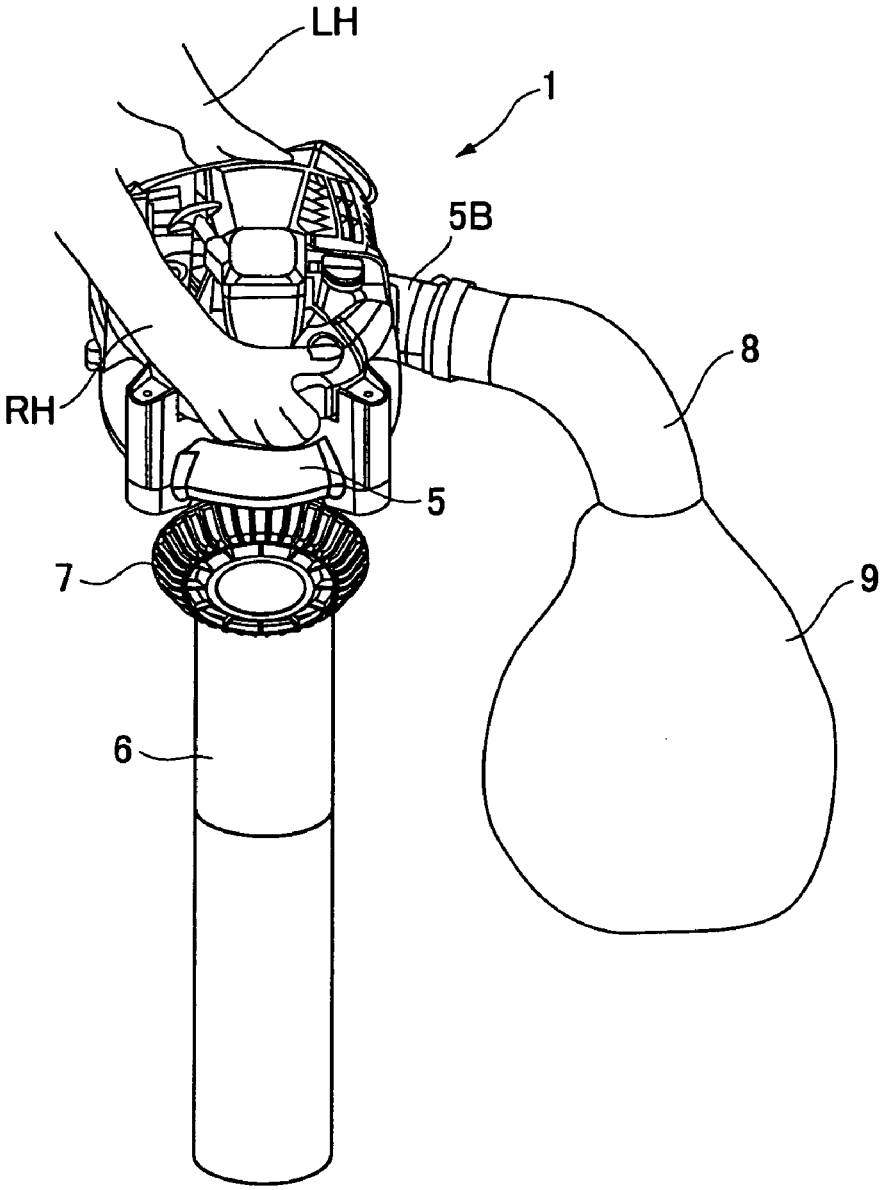
FIG. 10 shows the handheld vacuum/blower in the usage example viewed from another angle.
Figure 11A:
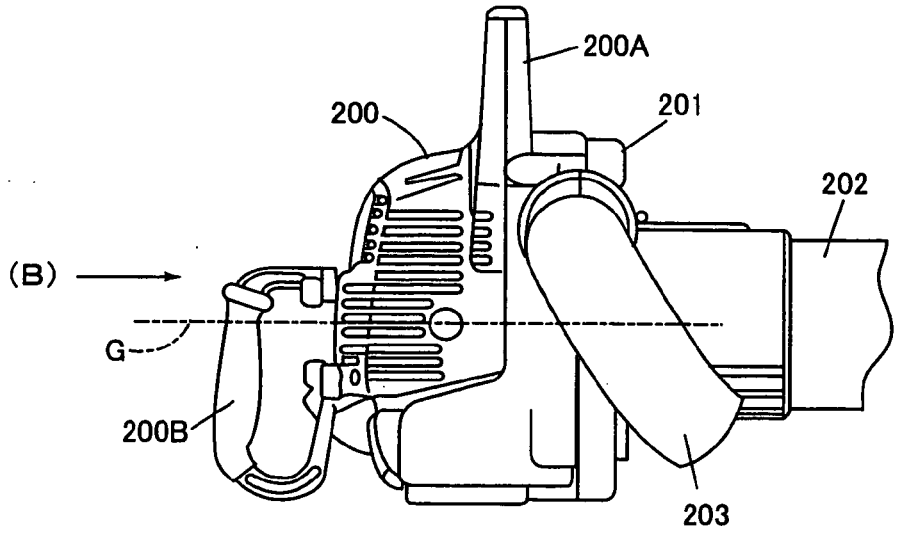
FIG.11 A PRIOR ART
FIG. 11A is a side view of a conventional engine-driven handheld vacuum/blower.
Figure 11B:
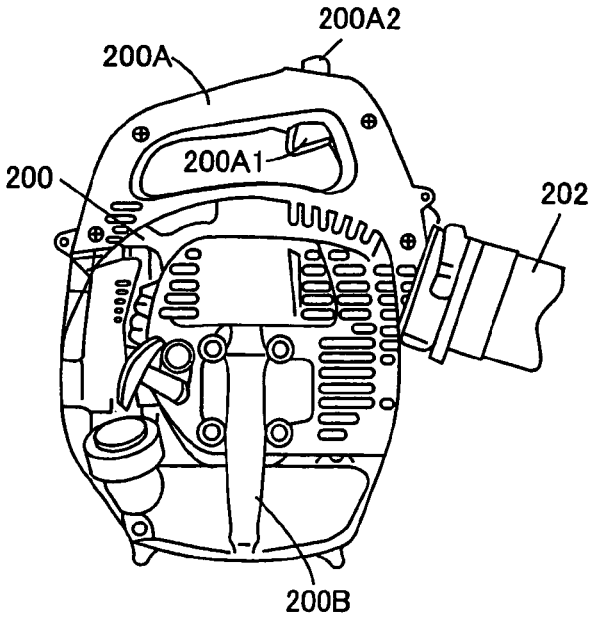
FIG.11 B PRIOR ART
FIG. 11B is a view taken from the direction of the arrow B in FIG. 11A.

In this case, the suction pipe 6 is inclined downward to the ground as shown in FIGS. 9 and 10 during the operation. To start the engine 2, a recoil starter 2A shown in FIG. 2 is pulled.

Vacuum generated by the engine-driven impeller 4 is applied at the distal end of the suction pipe 6 to collect dust and/or lightweight rubbish, which are taken into the dust bag 9 through the impeller case 5.

Figure 2:
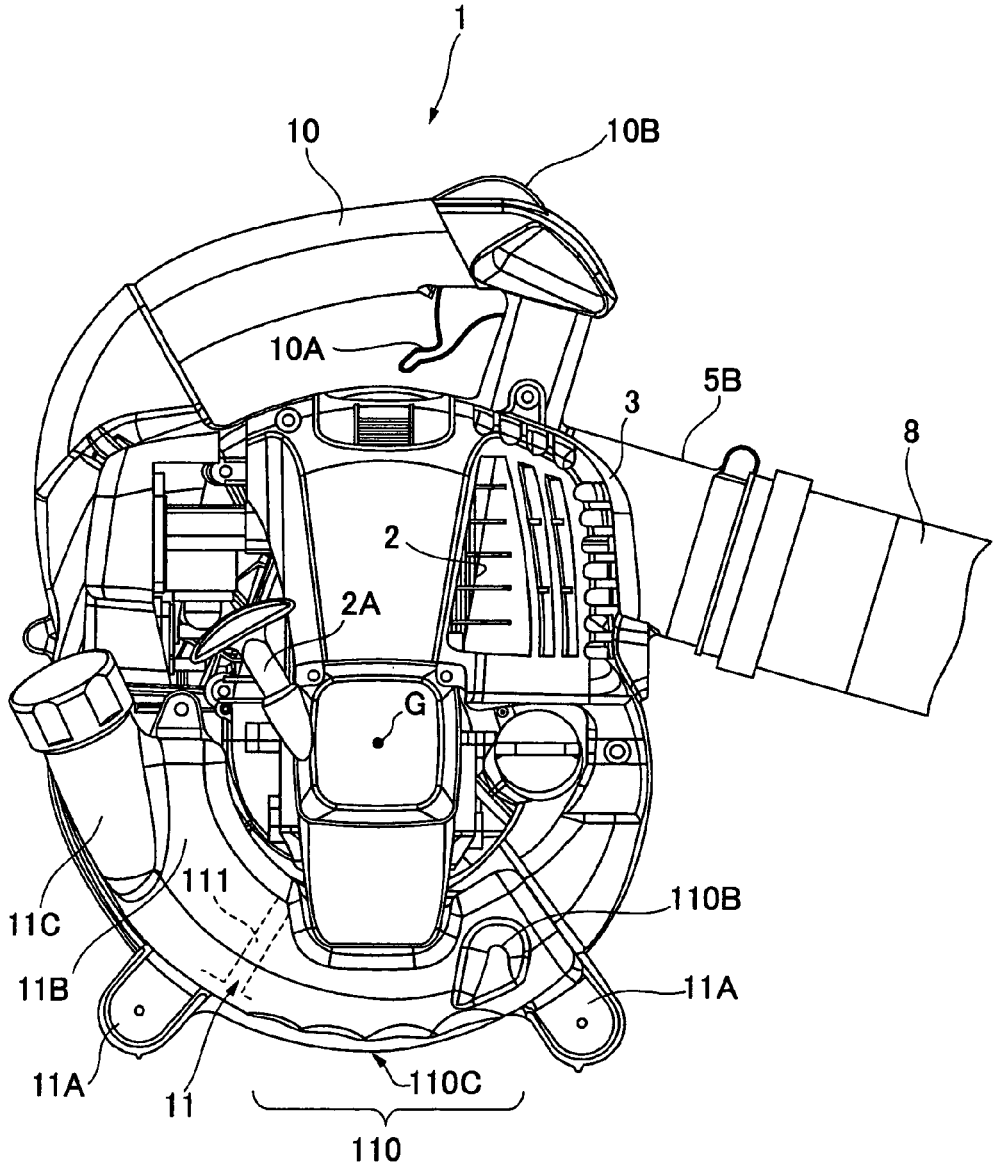
FIG. 2 is a side view of the handheld vacuum/blower of FIG. 1.

Referring to FIGS. 1 and 2, a first grip 10 is provided at the top of the engine casing 3, and a fuel tank 11, which includes a second grip 11 formed thereon, is positioned opposite the first grip across the center axis G of the engine 2.

The first grip 10 defines an arch on the engine casing 3 as shown in FIG. 2, and includes a throttle lever 10A on the inner side where the tips of the operator's fingers will be positioned, and a stop switch 10B on the opposite side.

The second grip is formed by part of the fuel tank 11.

The fuel tank 11 is positioned inside the outer contour of the engine casing 3 and on the opposite side of the first grip 10 from the center of the engine, and configured to conform to the outer contour of the engine casing 3 as shown in FIG. 2.

The fuel tank 11 is made of a transparent or translucent blow-molded plastic having a radius of curvature which is substantially the same as that of the impeller case 5 coupled to the engine casing 3 (see FIG. 2). The outer circumferential surface along the length of the fuel tank 11 is substantially parallel with the length of the first grip 10 as can be seen from FIG. 3. In this embodiment, the length of the fuel tank 11 is approximately half of that of the impeller case 5.

Continuing with FIGS. 2 and 3, the fuel tank 11 has brackets 11A which are fastened to mounting parts 3A on the engine casing 3 side provided individually from bosses 30 for mounting the engine, so that the tank is fixedly attached to the lower side of the engine casing 3.

Figure 4:
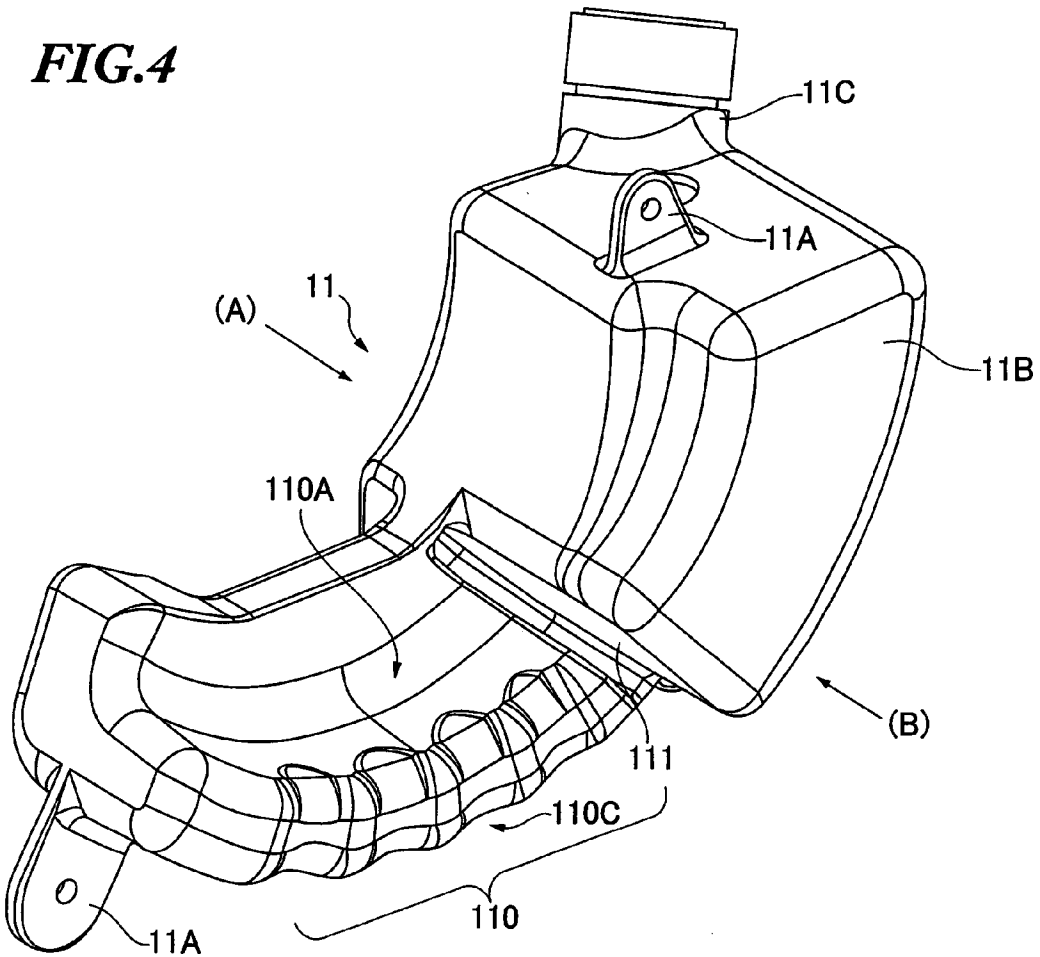
FIG. 4 is a perspective view for explaining the structure of a fuel tank used in the handheld vacuum/blower of FIG. 1.
Figure 5:
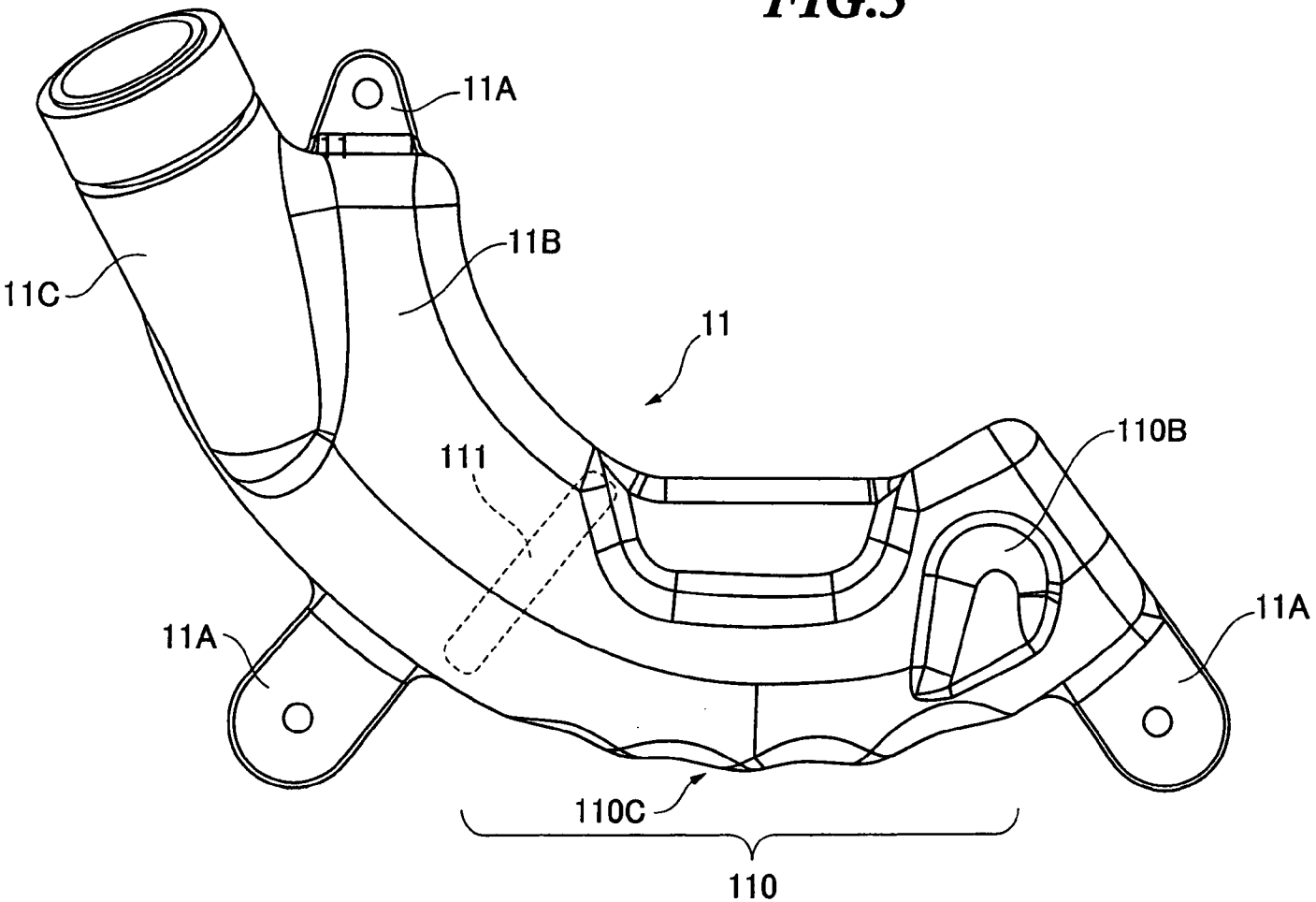
FIG. 5 is a view taken from the direction of the arrow A in FIG. 4.
Figure 6:
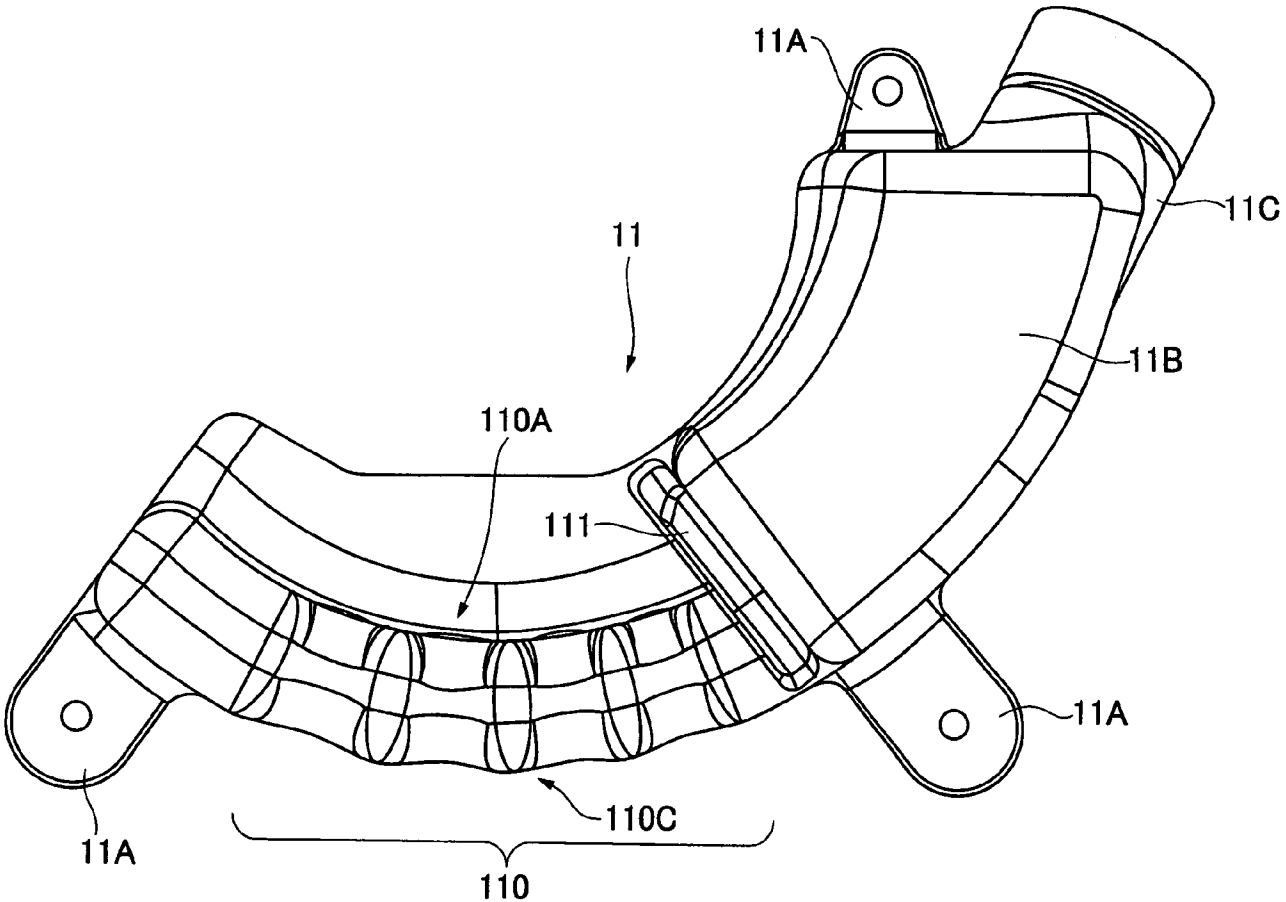
FIG. 6 is a view taken from the direction of the arrow B in FIG. 4.

The second grip, which is part of the fuel tank 11, is shown in detail in FIGS. 4 to 6. As shown in FIG. 4, the second grip 110 consists of a dented part 110A in the outer surface of the fuel tank 11 (see FIG. 6), which is oriented such that its lengthwise direction is parallel with that of the first grip 10. The dented part 110A includes a recessed portion 110B (FIG. 5) for receiving an operator's thumb and a series of continuous convexo-concave portions 1110C (FIG. 6) for receiving other fingers.

The continuous convexo-concave portions 110C are formed in the outer circumferential surface continuously with the side face of the fuel tank 11 as shown in FIG. 4, so that the operator's fingers other than the thumb can be inserted from the outer circumferential side into the inside.

The second grip 110 is defined by the area including the recessed portion 110B and the convexo-concave portions 10C in the lengthwise direction of the fuel tank 11. The dented part 110A has a reduced volume relative to the other part 11B of the fuel tank which is filled up with fuel. A partition 111 is provided inside the tank at the boundary where the volume is reduced.

The partition 111 separates the inside space of the fuel tank 11 into two parts, dividing the fuel-filled part 11B from the inner space of the second grip 110 so as to prevent fuel from flowing into the second grip 110. The fuel-filled part 11B has a port 11C for feeding fuel.

Between the fuel tank 11 and the engine 2 inside the engine casing 3 is placed an insulating protective member 12 as shown in FIG. 3 which illustrates the engine casing without the engine.

The insulating protective member 12 prevents fingers gripping the second grip 110 from touching the engine 2 directly, and mitigates the heat from the engine side. As shown in FIG. 3, the insulating protective member 12 is molded in one piece with the engine casing 3 such that it extends above the fuel tank 11. The insulating protective member 12 may be provided separately from the engine casing 3.

The insulating protective member 12 is positioned such that the distance L1 (FIG. 1) between itself and the second grip 110 of the fuel tank 11 is within a predetermined range. In this embodiment, the distance L1 is set 20 mm or more, preferably 25 mm or more.

This positioning allows an operator to readily insert the fingers to grip the second grip 110, and provides a large space between the fingers on the second grip and the insulating protective member 12, ensuring that heat from the engine is dissipated and not conducted to the fingers. The above specified values for the distance L1 are not a requirement of the invention, and the distance L1 can be freely set as long as it can achieve its functions.

Referring to FIG. 3, the insulating protective member 12 is formed with slits 12A along the lengthwise direction of the second grip 110 for forming outer air passages.

The slits 12A are opened on the side opposite the side face of the fuel tank 11. The opening or slit width L2 is set such that it is large enough to take in outer air but not so large as to allow the fingers gripping the second grip 110 to enter the opening. In this embodiment, the opening width L2 is set 10 mm or less based on the consideration of finger sizes of operators.

The slits 12A protect the fingers from heat as well as prevent overheat of the engine by taking in outer air. In this respect, there may be cases where it is not desirable to set the opening width L2 too small. In such cases, the opening width L2 should be determined in association with the number of slits so as to secure a certain amount of outer air which is sufficient to prevent overheat of the engine.

Figure 7:
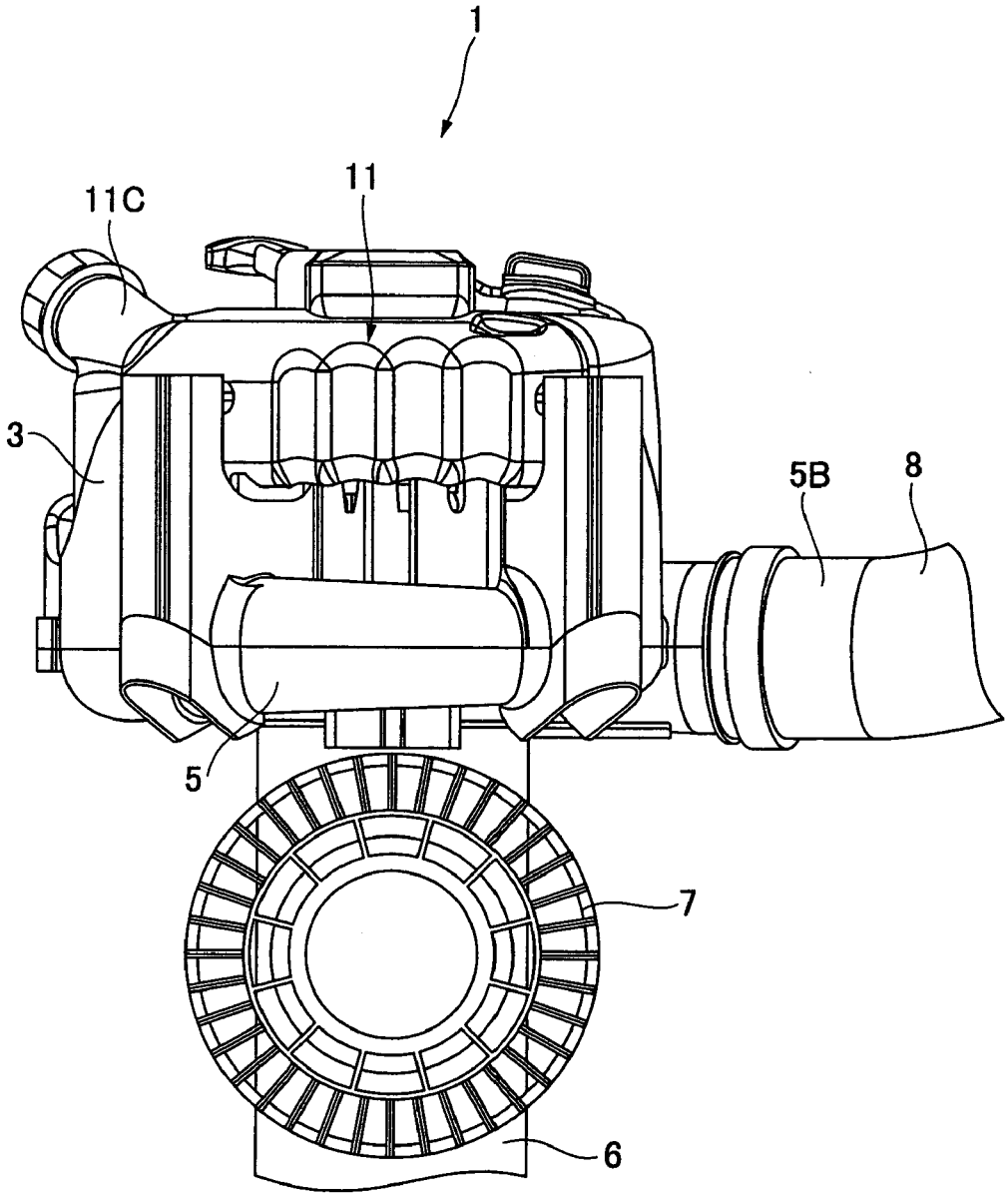
FIG. 7 is a bottom view of the handheld vacuum/blower according to the embodiment of the invention.
Figure 8:
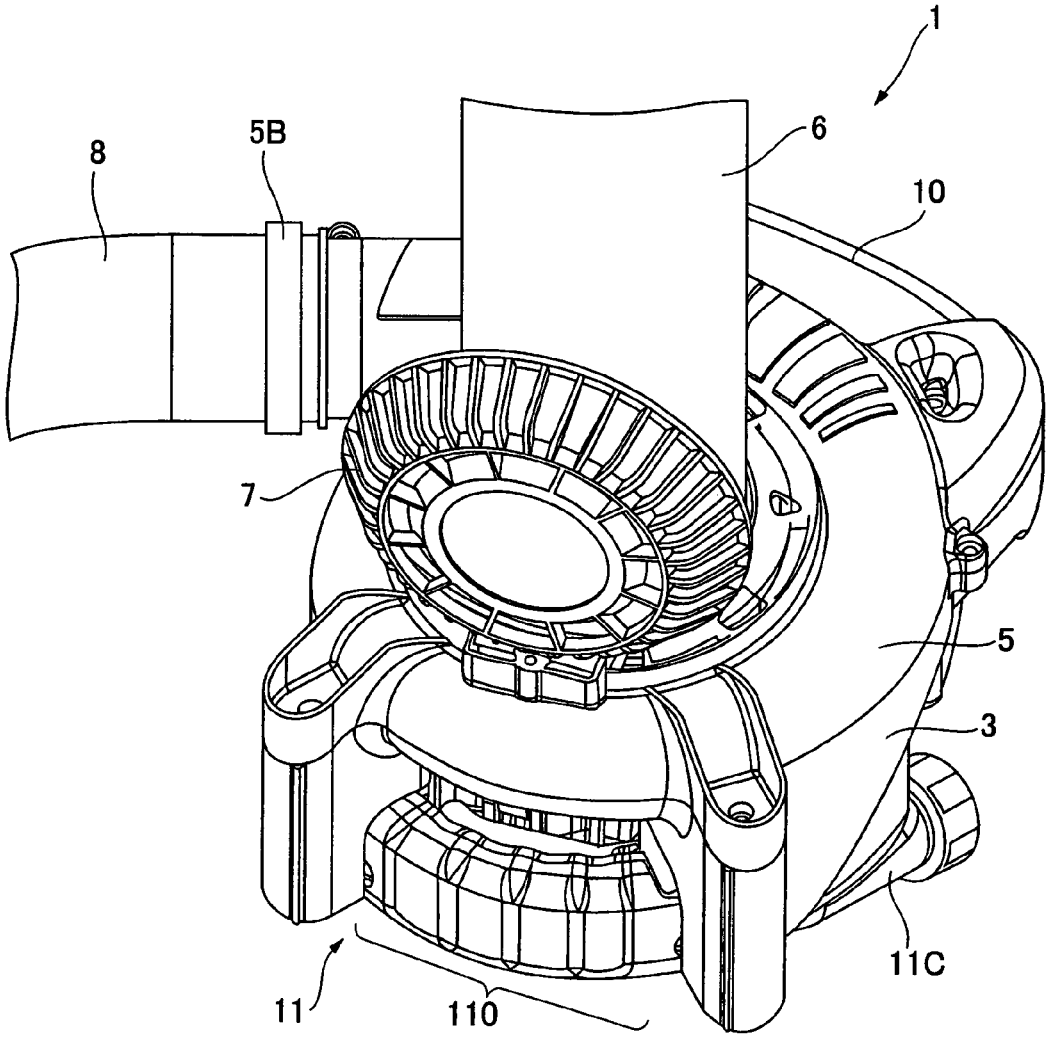
FIG. 8 is an external view of part of the handheld vacuum/blower according to the embodiment of the invention.

As discussed above and shown in FIGS. 7 and 8 the fuel tank 11 forms part of the outer shape of the engine casing 3. Since the fuel tank 11 conforms to the outer shape of the engine casing 3, the casing 3 need only have a size which is just to accommodate the engine. The first grip and second grip are thus provided compactly. In addition, because the grips are formed as one part of the outer shape of the engine casing 3, they need only have the same strength as the casing. That is, the grips need not have a strength high enough to withstand the entire weight of the vacuum/blower as would a stand, and thus can be made at low cost.

As the fuel tank 11 which makes up part of the outer shape of the engine casing 3 is transparent or translucent, the operator can visually check the remaining amount of fuel from outside.

In an actual operation, as shown in FIGS. 9 and 10, the operator holds the first grip 10 and the second grip 110 formed on the fuel tank 11 which are on the opposite sides of the center of the engine so as to support the vacuum/blower 1.

The first grip 10 is grasped from above, while the second grip 110 is held by the other hand (denoted at "RH" in FIG. 9) which is inserted from the bottom side of the fuel tank 11.

Because of the relative positions of the first and second grips 10 and 110 on the opposite sides of the engine, when the operator holds the grips, she/he can support the weight of the engine, which is the heaviest part of the vacuum/blower 1, equally with both hands (denoted at "RH" and "LH") as shown in FIG. 10. The load is well balanced between both grips, and the operator receives no unbalanced weight on either of the hands. Even in an operation where the engine casing 3 is oriented horizontally with the suction pipe 6 directed to the ground as shown in FIG. 10, the operator can hold the first and second grips with both hands at substantially the same level in the horizontal direction. Since the operator need not keep one hand inclined, there is no unbalanced load on either of the hands, and she/he can maintain her/his posture and work with the vacuum/blower under good efficiency.

The insulating protective member 12 between the second grip 110 and the engine 2 prevents the fingers on the grip 110 from touching the engine 2 directly. Further, because the insulating protective member 12 is spaced from the fingers at a predetermined distance, the heat from the engine is mitigated, so that the operator can keep holding the grip without feeling hot.

In this embodiment, the convexo-concave portions 110C of the second grip 110 are formed continuously to allow the operator to move the fingers other than the thumb among the convexo-concave portions. Since the operator can place the fingers at any position as she/he wishes to support the vacuum/blower 1 with, the operator can work with the vacuum/blower in a relaxed manner without experiencing any strain or discomfort.

While there has been described what are at present considered to be preferred embodiments of the present invention, it will be understood that various modifications may be made thereto, and it is intended that the appended claims cover all such modifications as fall within the true spirit and scope of the invention.

What is claimed is:

1. An engine-driven handheld vacuum/blower comprising:

a first grip provided as one part of an outer shape of an engine casing in which an engine used as a power source is mounted; and a second grip formed on a fuel tank which makes up another part of the outer shape of the engine casing, wherein the first grip and the second grip are positioned on opposite sides of a center axis of the engine, which can be held with palms of both hands of an operator opposed to each other, thereby making the vacuum/blower easy to operate.

2. The engine-driven handheld vacuum/blower according to claim 1, wherein the second grip is oriented such that its lengthwise direction is parallel to that of the first grip.

3. The engine-driven handheld vacuum/blower according to claim 1, wherein the second grip comprises a dented part formed on the surface of the fuel tank to receive operator's fingers.

4. The engine-driven handheld vacuum/blower according to claim 1, wherein the fuel tank comprises a transparent molded plastic member.

5. The engine-driven handheld vacuum/blower according to claim 3, wherein the fuel tank includes a partition inside which divides an area including the dented part of the second grip from another part of the fuel tank.

6. The engine-driven handheld vacuum/blower according to claim 1, further comprising:

an insulating protective member provided between the engine mounted in the engine casing and the fuel tank.

7. The engine-driven handheld vacuum/blower according to claim 6, wherein the insulating protective member includes an air passage for taking in outer air.

8. The engine-driven handheld vacuum/blower according to claim 6, wherein the insulating protective member is provided in one piece with an engine mounting part of the engine casing.

9. The engine-driven handheld vacuum/blower according to claim 3, wherein the dented part comprises a recessed part for receiving an operator's thumb.

10. The engine-driven handheld vacuum/blower according to claim 9, wherein the dented part further comprises a convexo-concave portion for receiving the fingers other than the thumb.

11. The engine-driven handheld vacuum/blower according to claim 3, wherein the dented part comprises a convexo-concave portion for receiving the fingers other than the thumb.

12. The engine-driven handheld vacuum/blower according to claim 1, wherein the fuel tank comprises a translucent molded plastic member.

13. The engine-driven handheld vacuum/blower according to claim 5, wherein the another part of the fuel tank is filled with fuel.

14. The engine-driven handheld vacuumlblower according to claim 6, wherein the insulating protective member is spaced from the second grip formed on the fuel tank at a distance which prevents operator's fingers on the second grip from touching the insulating protective member.

15. The engine-driven handheld vacuum/blower according to claim 7, wherein the air passage is formed by slits.

16. The engine-driven handheld vacuum/blower according to claim 7, wherein the air passage is formed by slits having a size that prevents passage of operator's fingers.

17. The engine-driven handheld vacuum/blower according to claim 1, wherein the first grip includes a throttle lever.

18. The engine-driven handheld vacuum/blower according to claim 1, wherein the first grip includes a stop switch.

19. The engine-driven handheld vacuum/blower according to claim 1, wherein the fuel tank is fixedly attached to the engine casing.

* * * * *